US010024546B2

(12) United States Patent
Smith et al.

(10) Patent No.: US 10,024,546 B2
(45) Date of Patent: Jul. 17, 2018

(54) METHOD AND APPARATUS FOR CONTROLLING OPERATION OF RANGE TOP COILS FOR COOKING

(71) Applicants: Todd A. Smith, Cleveland, TN (US); Matthew H. Brown, Cleveland, TN (US)

(72) Inventors: Todd A. Smith, Cleveland, TN (US); Matthew H. Brown, Cleveland, TN (US)

(73) Assignee: Brown Stove Works, Inc.TN (US)

( * ) Notice: Subject to any disclaimer, the term of this patent is extended or adjusted under 35 U.S.C. 154(b) by 7 days.

(21) Appl. No.: 15/461,072

(22) Filed: Mar. 16, 2017

(65) Prior Publication Data

US 2017/0356658 A1 Dec. 14, 2017

Related U.S. Application Data

(62) Division of application No. 15/181,545, filed on Jun. 14, 2016.

(51) Int. Cl.

| | |
|---|---|
| ***H05B 3/68*** | (2006.01) |
| ***H05B 1/02*** | (2006.01) |
| ***F24C 7/08*** | (2006.01) |
| ***H05B 3/24*** | (2006.01) |
| ***F24C 7/04*** | (2006.01) |

(52) U.S. Cl.

CPC ..... *F24C 7/088* (2013.01); *F24C 7/043* (2013.01); *H05B 3/24* (2013.01); *H05B 2213/07* (2013.01)

(58) Field of Classification Search

CPC . F24C 7/043; F24C 7/08; F24C 7/088; H05B 3/02; H05B 3/24; H05B 3/68; H05B 3/70; H05B 3/74; H05B 3/746; H05B 3/748; H05B 2213/04; H05B 2213/05; H05B 2213/07

USPC ..... 219/481, 443.1, 485, 446.1, 219/448.14–448.18, 452.12, 458.1, 462.1, 219/470, 471, 494, 448.11, 622, 624, 627, 219/660, 667, 675

See application file for complete search history.

(56) References Cited

U.S. PATENT DOCUMENTS

| | | | | |
|---|---|---|---|---|
| 5,856,654 | A * | 1/1999 | Frasnetti | H05B 3/746 219/481 |
| 6,133,552 | A | 10/2000 | Saulnier et al. | |
| 6,246,033 | B1 | 6/2001 | Shah | |
| 6,693,262 | B2 | 2/2004 | Gerola et al. | |
| 7,268,324 | B2 | 9/2007 | Liebold et al. | |
| 8,274,020 | B2 | 9/2012 | Donarski et al. | |
| 8,723,085 | B2 | 5/2014 | Callahan et al. | |
| 8,895,903 | B2 * | 11/2014 | de los Toyos Lopez | F24C 15/106 219/448.11 |
| 9,220,130 | B1 | 12/2015 | Smith | |
| 2004/0099652 | A1 | 5/2004 | Berkcan et al. | |
| 2005/0274710 | A1 | 12/2005 | Toyos et al. | |

* cited by examiner

*Primary Examiner* — Hung D Nguyen

(74) *Attorney, Agent, or Firm* — Stephen J. Stark; Miller & Martin PLLC

(57) ABSTRACT

A range has burner coil elements which have temperature switches as a portion of the replaceable coils. Upon reaching a predetermined temperature, the switch opens and power through the burner element is secured. The burner elements are preferably open coil units. Lowering the temperature in a cooking utensil below common ignition temperatures while still allowing boiling is an objective of many embodiments.

20 Claims, 3 Drawing Sheets

METHOD AND APPARATUS FOR CONTROLLING OPERATION OF RANGE TOP COILS FOR COOKING

CLAIM OF PRIORITY

This application is a divisional application of U.S. patent application Ser. No. 15/181,545 filed Jun. 14, 2016, which is incorporated by reference herein in its entirety.

FIELD OF THE INVENTION

The present invention relates to a method and devices for controlling the temperature of kitchen utensils on a burner element such as a surface burner element in an electric range.

BACKGROUND OF THE INVENTION

Many differing types of electric top surface cooking technologies are currently in existence. One of the most familiar means of top surface cooking is the use of exposed electrical coil elements. An electrical resistance core is typically embedded within an alloy sheath and wound in the shape of concentric circles. Typical shapes are available with three turns (6" diameter/1250 Watts) or four turns (8" diameter/2100 Watts). These types of elements are usually controlled by strictly mechanical means within a type of rotary electric switch. This type of cooking technology is very concise, economical and well accepted in the industry.

Cooking appliance standards classify top cooking sections as "attended cooking" features. This means that the user should be present to visually observe the heat source and the progress of the food being prepared. Typically, gas burner flames can be observed, or electrical indicators illuminate to show an active electrical element. The food dish may also require periodic attention such as stirring or draining.

Attended top cooking also implies that the user makes manual control adjustments to regulate cooking heat as needed. This may include turning down the heat setting once a boil has been established.

Many cooking accidents have been attributable to the user of a cooking appliance leaving the appliance unattended while performing what should have been attended top cooking. While the user is not present to make heat setting adjustments, pots of water may boil over or boil dry, or cooking oils may overheat and ignite thereby creating a fire which can be extremely problematic inside one's residence and/or business. There is still no absolute replacement for conscientious cooking practices.

U.S. Pat. No. 6,246,033 provides a method and apparatus for controlling operation of a range top heating element. After ten years of use in the market, this device still has not received wide-spread acceptance. Specifically, when installed on test ranges the applicant, the device has consistently prevented water from boiling.

The applicant developed the technology of U.S. Pat. No. 9,220,130, which is a substantial improvement over prior art constructions. However, there are potentially other ways to solve the problem at hand which could be implemented by heating coil manufacturers, possibly somewhat independently of stove manufacturers.

Accordingly, an improved system which still allows water to boil is believed to be desirable.

SUMMARY OF THE INVENTION

It is an object of many embodiments of the present invention to provide at least one of a device and method for limiting the temperature of potentially combustible material in cooking articles on the electric exposed eye(s) of a range for other cooking utensils cooking device.

It is another object of many embodiments of the present invention to provide an improved device and method for remotely sensing temperatures at a location spaced from the heating portion of coils of a burner element so as not to sense a significant amount of conducted heat, but instead primarily sense radiant heat from the traditional coil element construction so that traditional burner element coil elements can easily be installed and/or replaced together with the sensor.

It is another object of many embodiments of the present invention to provide an improved apparatus and method for sensing temperature related to a coil burner element with a switch activated along a portion of the coils themselves.

Accordingly, in accordance with a presently preferred embodiment of the present invention, an improved method and apparatus for controlling operation or installation of electric coil heating elements is provided. Specifically, a temperature sensing device is preferably located along a coil and/or preferably within a drip pan to sense temperature relative to a cooking utensil or article such as a pan, pot, skillet, etc., to attempt to keep the temperature of the cooking utensil and material therein below an ignition temperature of material commonly cooked on ranges.

Many embodiments have switches connected directly to the coil burner elements. The coil heating elements are received in sockets in the range. Some of the switches and/or sensors are disposed along at least substantially unheated portions of the elements, such as along cold rod portions.

Accordingly, a temperature circuit interruption switch can be provided preferably as a portion of the coil burner elements in an effort to reduce temperatures below a targeted threshold in the cooking appliance placed thereon at an upper limit and then restore electricity when temperature is below a lower limit. While not guaranteeing the elimination of cooking fires, the statistical likelihood of such a fire can be dramatically reduced.

Specifically, for at least some embodiments the temperature switch can be mounted within a volume of a drip pan preferably with the switch and/or sensor physically connected to the burner element. Some embodiments physically connect the temperature switch to a burner element or at least its wiring (preferably a non-heated portion) and if done so, preferably done as a part of the normally replaceable burner element, such as along a cold rod portion of the coil, normally between its connection to a socket and a heating portion of the coil. The wiring for the temperature switch can be part of the unit so that as the burner element is removed from a socket the temperature switch is removed with the element without a need to separately disassemble portions of the temperature sensing circuit.

The applicant's design for some embodiments prevents the temperature from exceeding something at or below 720 degrees Fahrenheit to prevent reaching the ignition temperature of some traditional ignition sources such as lard, butter, grease, etc., which ignite slightly above 700 degrees Fahrenheit but normally below the 800 degrees Fahrenheit. Temperatures less than, if not significantly less than, 700 degrees Fahrenheit in the burner may be required for some embodiments.

In the coil style ranges, the temperature switch may be supported by a housing, such as one connected to a portion of the coils. The temperature switch may be sealed to the housing to prevent moisture such as from an overflowed cooking container, or otherwise, from seeping onto an electrical contact or multiple contacts in an undesired manner. Furthermore, the temperature switch is preferably wired for many embodiments in series with the coil without a need for a separate processor. However, other embodiments may include a processor which may include a switch connected to a temperature sensor for more sophisticated embodiments.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
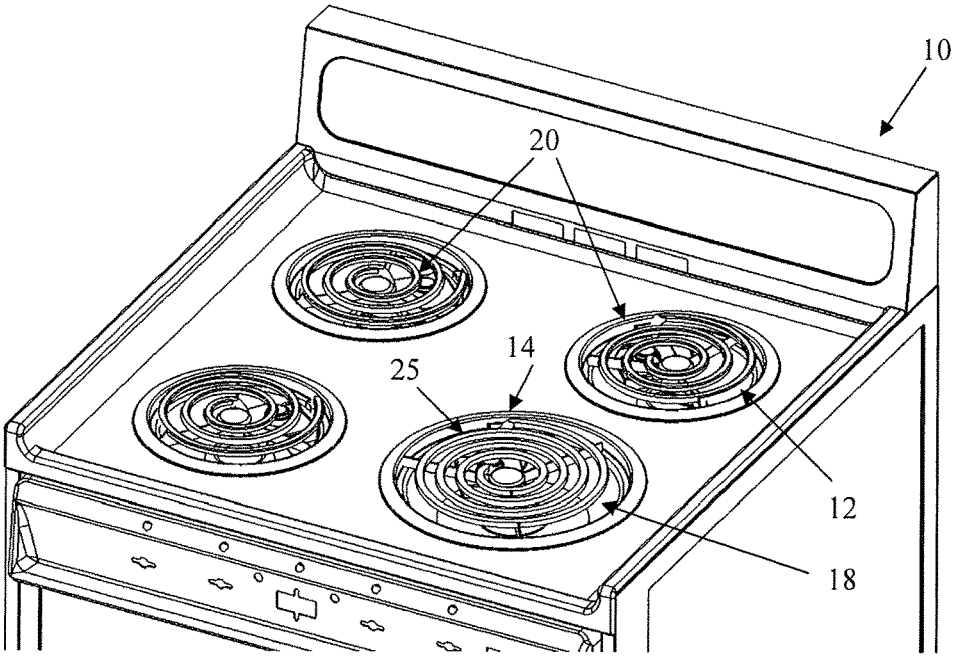
FIG. 1 is a top perspective view of the presently preferred embodiment of the present invention.

FIG. 1 shows a presently preferred embodiment of the present invention in the form of an electric range 10 having burner elements 12 shown as a part of the range 10 which is normally a removable heating element. Each one of the heating element(s) 12 is normally connected into a respective socket 14 so that the element 12 can be removed for cleaning and/or repair and/or replacement over time of the life of the range 10.

Although a standing range 10 is shown, slide in, or drop in or any other cooking range 10 having heated electric exposed eyes as heating element(s) 12 are contemplated particularly those having coils 16 as are known in the art for many embodiments. In the illustrated embodiment, heating element 12 has a series of three coils which is a typical 6" construction. Heating element 18 has four coils which is a typical 8" construction. Other constructions are also likely available in the marketplace.

What distinguishes the applicant's range 10 from prior art ranges is the operation and/or existence of temperature switch 20 which is shown with each of the elements 12,18 etc. Temperature switch 20 provides an ability to interrupt current flow through the socket 14 and/or into the heating elements 12 and/or 18 so that should the temperature exceed a predetermined upper limit or threshold at the temperature switch 20, then the electrical power to and/or through the heating element can be secured so that further heating cannot occur particularly so that flammable items which may possibly be a kitchen utensil on top of the element 12,18 are not as likely to be ignited or are significantly less likely to ignite than without such protection.

Figure 2:
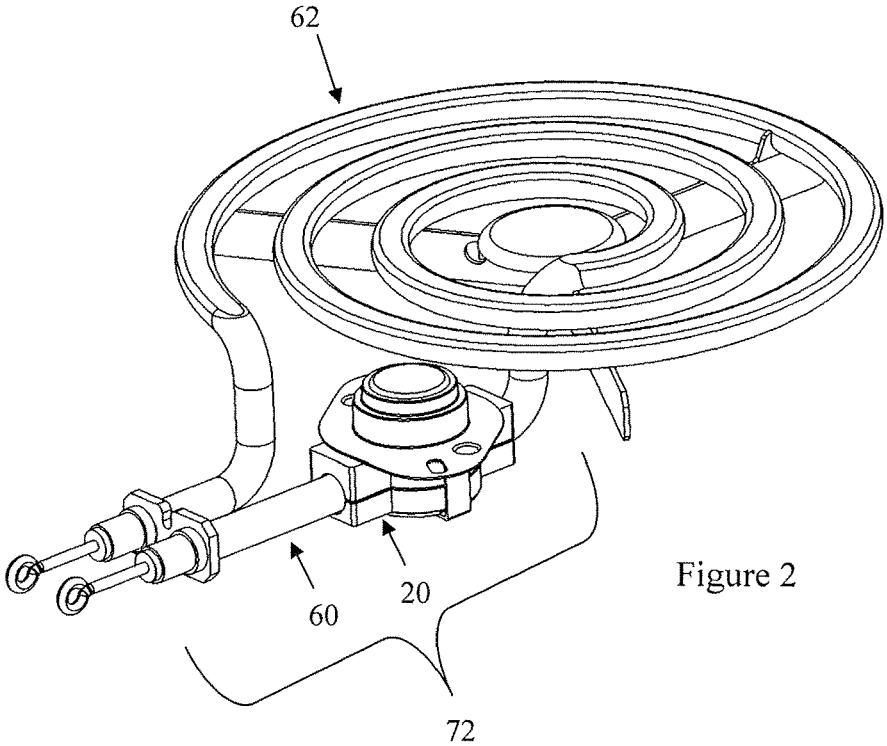
FIG. 2 is a side perspective view of one the heating elements shown in FIG. 1 removed relative to the stove and its drip bowl.

FIG. 2 shows the temperature switch 20 extending along a portion of the coil element 12,18, such as along a cold rod portion 60 of the element 12,18. Cold rod portions 60 are non-heated or unheated, even when the coil 16 is heated and/or energized. The switch is thus, preferably located within a volume of a drip bowl 24 (also known as a drip pan) such as intermediate a bore 22 and 25 in the drip pan 24 and an uppermost surface 62 of the element 12,18 or even below the coil 16 which are normally the circular planarly disposed rings which generate heat when the elements 12,18 are turned on. The uppermost surface 62 is typically where a cooking utensil would be located during use. The temperature switch 20 may have an upper surface 26 that extends an elevation above an upper surface 28 of bore 22 such as is shown in FIG. 4, while preferably being at or below an upper most surface 62 of the element 12,18.

Figure 4:
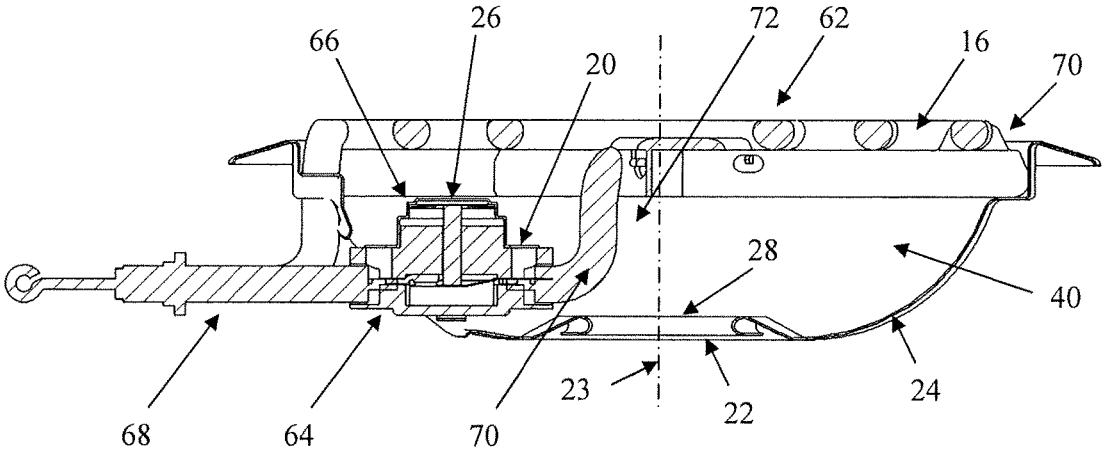
FIG. 4 is a cross-sectional view taken along a heating element shown in FIG. 1.
Figure 5:
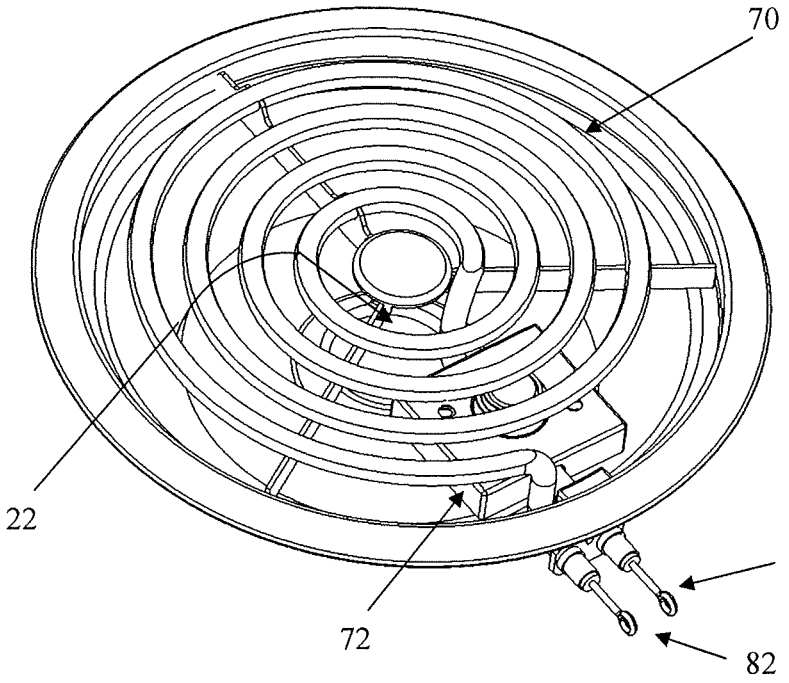
FIG. 5 is a top perspective view of the invention shown in FIGS. 1, 2 and 4 with the range top removed which supports the heating elements and drip bowls.

As can be seen in FIG. 4, the upper surface 26 of the temperature switch 20 is preferably located within the drip bowl or pan cavity 40 and below an upper surface of coil 16 if not below the coil 16. Some embodiments, such as the one illustrated, do not align the switch 20 along an axis 23 of the bore 22 in the drip pan 24. Instead, the switch 20 is preferably located along a "cold rod" or other unheated portion of the coil 16. "Rings" 70 of coils 16 are heated during use, while unheated portions 72 are normally located below the rings 70. For many embodiments, the location can be off of the axis 23, such as illustrated. Other embodiments may be able to locate the temperature switch 20 higher or lower relative to the embodiment shown along the heating element 12. The switch 20 is preferably radiantly heated by the coils 16 for many embodiments, although possibly some conductive heat could be transmitted with other embodiments.

Through trial and error, the temperature rating of the temperature switches 20 for the respective heating or burner elements 12,18 (also referred to as eyes) were selected by the applicant (four eyes, or burner elements 12,18 are shown in FIG. 1, and at least three are very common for many embodiments, with each somewhat similarly constructed with a respective switch 20 in the illustrated embodiment). Trials were used to arrive at desired temperature settings. Although the temperature setting of 500 degrees Fahrenheit worked satisfactorily for aluminum pans, the applicant discovered that a predetermined temperature of 375 degrees Fahrenheit setting was more desirable for the 8" element when using cast iron skillets due to the amount of heat that could be retained by a cast iron skillet to potentially cause an ignition in at least some situations even with electricity secured to the heating element. Other embodiments may use different temperature settings to open the switch 20 such as about 400, 425, 450, 475, 500 Fahrenheit or potentially anything up to about 700 degrees up to and preferably below about 700 degrees Fahrenheit for the upper predetermined temperature limit. A similar lower temperature limit setting was utilized to restore the flow of electricity (i.e., close the switch 20) as the upper limit, but various embodiments need not necessarily have the same predetermined temperature for upper and lower settings.

Although the use of the temperature switch has been found to delay the time for water to boil on an open coil 16, it has not been found to completely prevent or prohibit such action as has the technology of U.S. Pat. No. 6,246,033 in which water will not boil in any test the applicant has conducted.

A wide range of temperature switches are available to the marketplace. A Therm-O-Disc™ brand switch was used particularly effectively by the applicant. These discs come with predetermined settings and the applicant selected about a 375 degree setting (upper and lower limit) for the preferred embodiment although other embodiments can certainly take other temperature settings depending on the placement of the temperature sensor relative to the coil 16 and its size and the relative size of the drip pan cavity 40 and/or other factors.

In the illustrated embodiment, the switch 20 is a temperature disc 66 as described above located in a housing 64 possibly having sealing gasket(s) 38 which can withstand temperatures of up to 375 degrees Fahrenheit, if not 500 or more degrees Fahrenheit. Furthermore, housing 64 can connect element portions 68 and 70 to normally be in electrical conductance with one another until the switch 20 is activated by heat and then creates an electrical short therebetween (as would be understood by those of ordinary skill in the art) and then reconnects when below a predetermined temperature. Element portions 68,70 are preferably unheated portions of elements 12,18, and are normally located below the coil 16 (coil 16 is normally circular rings located in a plane) that are often used to connect the coil 16 to the socket 14.

Figure 3:
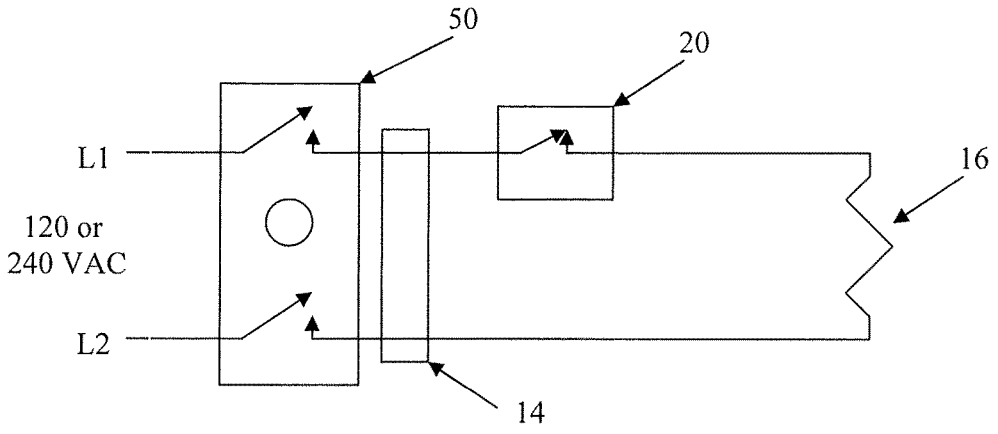
FIG. 3 is a circuit diagram showing a presently preferred embodiment of the present invention.

FIG. 3 provides a schematic of the operation showing 120 Volts provided to the top of the range 10 although 240 Volts could be provided in other embodiments. Electricity is directed through a heat controller 50 which can direct the flow of electrical energy to a particular coil 16 as would be understood by those of ordinary skill in the art, the difference being that the temperature switch 20 may either break the flow of electricity (i.e., open switch 20) or allow it (closed switch 20). As can be seen from the simple circuit, the temperature switch 20 is formed or otherwise provided series with the heating or burner element 12 for the preferred embodiment opposite the socket 14 from the heat controller 50. This is a different construction than was described in U.S. Pat. No. 9,330,130 which shows the switch 20 being opposite the socket 14 from the coil 16 in FIG. 4 of that reference. Other embodiments may use a switch controller with a remote temperatures sensor for more sophisticated embodiments. Also, unlike U.S. Pat. No. 8,723,085, the switch 20 is not conductively heated by a thermal plate heated by the heating elements, particularly at a location above the heating elements.

Unlike U.S. Pat. No. 9,220,130, the heating elements 12,18 having the switch 20 as a portion thereof, have only two prongs (instead of three). Furthermore, the switch 20 is located below the coil 16, and also along a cold rod 60 so as to be at an un-heated portion of the elements 12,18 so as to preferably receive heat radiantly as opposed to conductively. The switch 20 also can be located in a housing 64 along the cold leg so as to assist in protecting the switch 20 and also be replaceable as an integral portion of the elements 12,18 so as to be able to be retrofitted into an existing range, or be replaceable into sockets 14 if the elements 12,18 fail over time.

As can be seen by various embodiments, electrical stoves can be made much safer although there is no electrical gadget can guarantee the prevention of fires in the absence of vigilance by the operator. Electrical stoves should be watched at all times by those parties using them.

No party is known to provide a temperature switch as a portion of a two pronged burner element for securing electrical power to the burner coil upon reaching a predetermined temperature. This allows for burner coil manufacturers to provide coils to manufacturers and/or consumers for use in the marketplace to replace existing coils and/or work with specific models of stoves to prevent a situation of reaching an ignition temperature.

No party is known by the applicant to provide a temperature switch and/or sensor as a portion of two pronged coils such as in the drip pan cavity, at the drip pan bore, and/or proximate to the drip pan bore (or elsewhere) for use in securing power to a particular heating element upon exceeding a predetermined upper limit and then restoring power when dropping below a predetermined lower limit.

Furthermore, no party is known to provide a temperature switch 20 and/or sensor which is along a cold rod portion of the coil 16, and particularly those which are triggered at least principally by radiant heat as opposed to conductive heat.

One potential drawback of this design is that a consumer could replace the heating elements 12,18 shown herein with traditional coils (which do not have switches 20). However, in order to prevent such an action the prongs 80,82 and/or socket 14 could be configured so that the elements 12,18 could be received within socket 14, but those prior art coils might be made to be incompatible with socket 14 of new ranges designed to be used with the new elements 12,18 (although traditional prong constructions are illustrated in the figures).

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An electric cooking appliance comprising:

a first exposed coil electric heating element received when installed at an upper surface of the cooking appliance, said first exposed coil electric heating element plugging into a socket of the cooking appliance;

a heat controller selectively directing a flow of electricity from the cooking appliance, and through the socket, to the first exposed coil; and a temperature activated switch electrically connected in series with the first exposed coil electric heating element, and the temperature activated switch is physically connected to the first exposed electric coil, wherein the socket is located electrically intermediate the temperature activated switch and the heat controller, when installed, and a housing receiving and extending beyond an outer perimeter of an upper surface of the temperature activated switch; and first and second rod portions of the first exposed coil electric heating element connect to the temperature activated switch internal to portions of the housing;

wherein upon reaching a predetermined upper temperature, the temperature activated switch opens thereby preventing the flow of electricity through the first exposed coil electric heating element and when the temperature is below a predetermined lower temperature, the temperature activated switch closes permitting the flow of electricity through the first exposed coil electric heating element.

2. The electric cooking appliance of claim 1 wherein the temperature activated switch is located at one of at and below an upper surface of the first exposed coil electric heating element with the housing receiving ends of the first and rod portions of the first exposed coil electric heating element therein.

3. The electric cooking appliance of claim 1 wherein the temperature activated switch is located within a volume of a drip pan cavity formed by at least a portion of the drip pan and the first exposed coil electric heating element, when installed.

4. The electric cooking appliance of claim 1 wherein the temperature activated switch has a temperature sensor and switch combination surrounded by the housing.

5. The electric cooking appliance of claim 1 wherein said housing supports the upper surface of the temperature activated switch above and intermediate opposing ends of the first and second rod portions, when installed.

6. The electric cooking appliance of claim 1 wherein the temperature activated switch is heated at least partially by the first exposed coil electric heating element.

7. The electric cooking appliance of claim 1 wherein the first exposed coil heating element is one of multiple similar heating elements with respective temperature activated switches, each in electrical series with the heating elements, respectively.

8. The electric cooking appliance of claim 1 wherein the predetermined upper temperature is selected to prevent ignition of a food product in a cooking article supported by the first exposed coil electric heating element.

9. The electric cooking appliance of claim 1 wherein the predetermined lower temperature is selected to assist in minimizing an amount of time for water to boil in a cooking article supported by the first exposed coil electric heating element.

10. The electric cooking appliance of claim 1 wherein the predetermined upper temperature is selected to prevent ignition of certain material in a cooking article placed on the first exposed coil electric heating element.

11. The electric cooking appliance of claim 1 wherein the temperature activated switch is a temperature disc.

12. An electric exposed coil heating element comprising:

an exposed resistance heating electric coil which provides conductive heat to a cooking utensil through contact of the cooking utensil with the coil upon receipt of electricity from a first to a second plug-in connection;

a temperature activated switch physically connected to the coil and electrically connected in series with the coil, with the temperature activated switch located intermediate the first and second plug in connections and at or below the upper surface of the coil, said temperature activated switch retained by a housing, said housing extending beyond a perimeter of an upper surface of the temperature activated switch and physically secured to the exposed resistance heating coil; and first and second rod portions of the first exposed coil electric heating element entering the housing and connecting to the switch internal to portions of the housing;

wherein when the temperature switch reaches a predetermined upper temperature, the temperature activated switch opens thereby preventing the flow of electricity intermediate the first and second plug in connections through the exposed resistance heating electric coil, and when the temperature drops below a predetermined lower temperature, the temperature activated switch closes thereby permitting the flow of electricity through the first and second plug in connections through the exposed resistance heating electric coil.

13. The electric exposed coil heating element of claim 12 in combination with a range.

14. The electric exposed coil heating element of claim 13 wherein the range has a socket which receives the first and second plug in connections.

15. The electric exposed heating element of claim 13 wherein the range further comprise a heat controller selectively directing a flow of electricity to the first exposed coil, with the socket located intermediate the temperature activated switch and the heat controller.

16. The electric exposed heating element of claim 12 wherein the switch is located intermediate oppositely directed segments of the coil in a conductor leg along a cold rod and the housing connects to ends of the segments with an upper surface of the switch located intermediate the ends of the segments.

17. The electric exposed heating element of claim 12 wherein the temperature activated switch is a temperature disc.

18. An electric cooking appliance comprising:

a first exposed coil electric heating element received when installed at an upper surface of the cooking appliance, said first exposed coil electric heating element plugging into a socket of the cooking appliance;

a heat controller selectively directing a flow of electricity from the cooking appliance, and through the socket, to the first exposed coil; and a temperature activated switch connected in series with the first exposed coil electric heating element, a housing receiving and extending beyond an outer perimeter of an upper surface of the temperature activated switch; and the temperature activated switch is physically connected to the first exposed electric coil with housing portions of the housing receiving oppositely directed first and second cold rod portions with an upper surface of the temperature activated switch located intermediate the first and second cold rod portions and the housing spanning the first and second cold rod portions, wherein the socket is located electrically intermediate the temperature activated switch and the heat controller, when installed;

wherein upon reaching a predetermined upper temperature, the temperature activated switch opens thereby preventing the flow of electricity through at least some of the heating coils of the first exposed coil electric heating element, and when the temperature is below a predetermined lower temperature, the temperature activated switch closes permitting the flow of electricity through the at least some of the heating coils of the first exposed coil electric heating element.

19. An electric exposed coil heating element comprising:

an exposed resistance heating electric coil which provides conductive heat to a cooking utensil through contact of the cooking utensil with the coil upon receipt of electricity from a first to a second plug-in connection;

a temperature activated switch located in a housing, said housing extending beyond an outer perimeter of an upper surface of the temperature activated switch, said temperature activated switch physically connected to first and second cold rod portions of the coil and electrically connected in series with the coil, with the switch located intermediate the first and second plug in connections and having an upper surface at or below the upper surface of the coil, with the first and second cold rod portions of the first exposed coil electric heating element received internally within portions of a housing holding the temperature activated switch with the housing spanning the first and second cold rod portions;

wherein when the temperature activated switch reaches a predetermined upper temperature, the temperature activated switch opens thereby preventing the flow of electricity intermediate the first and second plug in connections through the exposed resistance heating electric coil, and when the temperature drops below a predetermined lower temperature, the temperature activated switch closes thereby permitting the flow of electricity through the first and second plug in connections through the exposed resistance heating electric coil.

20. The electric exposed heating coil heating element of claim 19 wherein the first and second cold rod portions oppose one another relative to the housing.

* * * * *